US010634001B2

(12) United States Patent
Scotti Del Greco et al.

(10) Patent No.: US 10,634,001 B2
(45) Date of Patent: Apr. 28, 2020

(54) DEVICE FOR CONTROLLING THE FLOW IN A TURBOMACHINE, TURBOMACHINE AND METHOD

(71) Applicant: Nuovo Pignone Tecnologie Srl, Florence (IT)

(72) Inventors: Alberto Scotti Del Greco, Florence (IT); Sen Radhakrishnan, Bangalore (IN); Rajesh Kumar Venkata Gadamsetty, Bangalore (IN); Matthias Carl Lang, Garching b. Muenchen (DE); Ismail Hakki Sezal, Garching b. Munich (DE)

(73) Assignee: Nuovo Pignone Srl, Florence (IT)

( * ) Notice: Subject to any disclaimer, the term of this patent is extended or adjusted under 35 U.S.C. 154(b) by 190 days.

(21) Appl. No.: 15/547,101

(22) PCT Filed: Jan. 27, 2016

(86) PCT No.: PCT/EP2016/051685
§ 371 (c)(1),
(2) Date: Jul. 28, 2017

(87) PCT Pub. No.: WO2016/120316
PCT Pub. Date: Aug. 4, 2016

(65) Prior Publication Data

US 2018/0023586 A1 Jan. 25, 2018

(30) Foreign Application Priority Data

Jan. 28, 2015 (IT) ..... CO2015A0001

(51) Int. Cl.
*F01D 17/16* (2006.01)
*F01D 5/14* (2006.01)
(Continued)

(52) U.S. Cl.
CPC ..... *F01D 17/165* (2013.01); *F01D 5/146* (2013.01); *F04D 29/444* (2013.01); *F04D 29/462* (2013.01)

(58) Field of Classification Search
CPC ..... F01D 5/146; F01D 17/16; F01D 17/162; F01D 17/165; F04D 29/444; F04D 29/462
See application file for complete search history.

(56) References Cited

U.S. PATENT DOCUMENTS 2,316,452 A * 4/1943 Pfenninger ..... F01D 17/162 417/323
2,428,830 A * 10/1947 Birmann ..... F01D 17/165 415/116
(Continued)

FOREIGN PATENT DOCUMENTS

DE 901010 C * 1/1954 ..... F20B 33/00
DE 4208311 A1 * 9/1993 ..... F01D 9/02
(Continued)

OTHER PUBLICATIONS

Full English translation of JP 2009264305 (Year: 2009).*
(Continued)

*Primary Examiner* — Moshe Wilensky
*Assistant Examiner* — Topaz L. Elliott
(74) *Attorney, Agent, or Firm* — Baker Hughes Patent Organization

(57) ABSTRACT

A device for controlling the flow in a turbomachine, in an embodiment, a centrifugal compressor; the device includes a plurality of fixed blades and a plurality of adjustable blades adjacent to the plurality of fixed blades so that each of the adjustable blades has an aerodynamic interaction with one of the fixed blades; each of the adjustable blades is pivoted to rotate about a fixed axis substantially located at the center of
(Continued)

pressure of the adjustable blade; the center of pressure is evaluated when the blade is at a reference orientation.

12 Claims, 7 Drawing Sheets

(51) Int. Cl.
*F04D 29/46* (2006.01)
*F04D 29/44* (2006.01)

(56) References Cited

U.S. PATENT DOCUMENTS

| | | | | | |
|---|---|---|---|---|---|
| 2,648,195 | A * | 8/1953 | Wilde | F01D 17/143 | 60/794 |
| 2,733,853 | A | 2/1956 | Trumpler | | |
| 3,442,493 | A | 5/1969 | Smith, Jr. | | |
| 4,856,962 | A * | 8/1989 | McDow | F01D 17/162 | 415/115 |
| 4,877,370 | A * | 10/1989 | Nakagawa | F04D 29/444 | 415/148 |
| 5,165,849 | A | 11/1992 | Nakagawa et al. | | |
| 6,715,983 | B2 * | 4/2004 | Koshoffer | F01D 5/146 | 415/1 |
| 7,520,716 | B2 * | 4/2009 | Tacconelli | F04D 27/0246 | 415/148 |
| 7,905,703 | B2 * | 3/2011 | Cruickshank | F04D 29/444 | 415/199.2 |
| 8,226,356 | B2 * | 7/2012 | Kay | F01D 5/147 | 415/119 |
| 8,702,381 | B2 * | 4/2014 | Alajbegovic | F01D 17/165 | 415/162 |
| 9,062,559 | B2 * | 6/2015 | Little | F01D 17/162 | |
| 10,012,103 | B2 * | 7/2018 | Pachidis | F01D 5/146 | |
| 2011/0135441 | A1 | 6/2011 | Sorokes et al. | | |
| 2016/0130973 | A1 * | 5/2016 | Pachidis | F01D 5/146 | 415/148 |

FOREIGN PATENT DOCUMENTS

| | | | | |
|---|---|---|---|---|
| EP | 1 340 894 | A2 | 9/2003 | |
| EP | 2 460 978 | A1 | 6/2012 | |
| FR | 3 001 005 | A1 | 7/2014 | |
| FR | 3069020 | A1 * | 1/2019 | F04D 27/0246 |
| GB | 605533 | A * | 7/1948 | F20B 33/00 |
| GB | 824270 | A * | 11/1959 | F04D 29/462 |
| JP | 61135998 | A * | 6/1986 | |
| JP | 2009-264305 | A | 11/2009 | |
| WO | 2005/064168 | A1 | 7/2005 | |
| WO | WO-2012112892 | A2 * | 8/2012 | F03B 15/00 |

OTHER PUBLICATIONS

Kirk, D. "MAE 3241 Aerodynamics and Flight Mechanics" Thin Airfoil Theory, Florida Institute of Technology accessed from http://my.fit.edu/~dkirk/3241/Lectures/TAFT (Year: 2010).*

EPO Office Action in Corresponding Application EP 16701656, dated Nov. 29, 2019 (Year: 2019).*

Search Report and Written Opinion issued in connection with corresponding IT Application No. C02015A000001 dated Sep. 17, 2015.

International Search Report and Written Opinion issued in connection with corresponding WO Application No. PCT/EP2016/051685 dated Mar. 31, 2016.

International Preliminary Report on Patentabilty issued in connection with corresponding WO Application No. PCT/EP2016/051685 dated Aug. 1, 2017.

* cited by examiner

α=+40°

α=+20°

α=0°

α=-20°

DEVICE FOR CONTROLLING THE FLOW IN A TURBOMACHINE, TURBOMACHINE AND METHOD

TECHNICAL FIELD

Embodiments of the subject matter disclosed herein correspond to devices for controlling the flow in a turbomachine, turbomachines and methods.

BACKGROUND

A turbomachine comprises statoric and rotoric bladerows, exchanging angular momentum with the fluid. A fluid with angular momentum is also called a swirling fluid. The swirl is said positive if it has the same sense of the rotating speed and negative in the opposite case.

In a turbine the statoric bladerows generate a positive angular momentum in the fluid at expenses of a pressure drop, while the rotoric bladerows extract this angular momentum from the fluid and convert it into torque on the shaft.

On the contrary, in a compressor the rotoric blades provide a positive angular momentum into the fluid at expenses of torque on the shaft, while the statoric bladerows convert this angular momentum into an increase of fluid pressure.

This mechanism is repeated for each stage, i.e. for each pair of rotoric and statoric bladerows.

In case of a compressor, the residual angular momentum after the statoric bladerows can be positive or negative or, of course, it can vanish. As a result, the downstream stage is said respectively unloaded or overloaded, as compared to a reference case where the flow has no swirl at the inlet.

As a matter of fact, a positive angular momentum at the inlet of a stage reduces the work required for providing a given amount of positive angular momentum at the exit. This means that the stage absorbs a lower power for the same mass flow rate and therefore it is said unloaded.

For the opposite reason, a negative angular momentum at the inlet of a stage increases the absorbed power for the same mass flow. In such conditions the stage is said overloaded.

Generally, as compared to the absence of inlet swirl, the polytropic head developed by a compressor stage, for a given mass flow, is a bigger quantity if the angular momentum at inlet is negative (overloaded stage) and smaller if it is positive (unloaded stage).

Due to the typical negative slope of the head-flow curve, a centrifugal compressor stage with positive swirl will deliver the same head at a lower flow than an equal stage without inlet swirl. For the opposite reason, the flow will increase for a stage with negative swirl at inlet.

On this principle the adjustable inlet guide vanes (IGV) are based: IGV control the swirl at the inlet of a stage, and in this way they increase or decrease the flow delivered for a given head. In this sense, overall IGV are a device for controlling the flow of a turbomachine.

In the field of "Oil & Gas", multistage centrifugal compressors may be equipped with adjustable IGV at many locations inside the machine. They are typically installed in front of the first stage, but there are also cases where IGV are upstream of an intermediate stage.

As far as an intermediate stage is concerned, known IGV are defined by the rear portion a kind of moveable tail of the blades of the upstream return channel. Such tail can be pivoted around a fixed axis, thus working as IGV for the downstream stage.

In the prior art, this tail rotates about an axis substantially located close to its leading edge and there is a position—the reference one—where this tail substantially forms an integrated airfoil with the fixed part of the blade. In other words, in the prior art, the IGV for an intermediate stage is just obtained by splitting a conventional blade in two pieces and making adjustable one of them, the so-called tail. FIG. 1 shows a blade of an IGV device in two pieces with a moveable tail according to the prior art.

Known IGV devices do not fully meet the ideal requirements of controlling the flow with minimum losses and minimum actuation force, that is the force one should apply to overwhelm the resistance forces and rotate the IGV. The resistance forces comprises the friction forces inside the actuation mechanism and the forces due to the change of angular momentum of the flow. Indeed a change of the angular momentum of the flow reflects into a pressure distribution over the whole IGV profile and into a consequent torque to be overwhelmed with respect to the pivot of the IGV.

More in detail, the IGV devices of the prior art have at least two disadvantages. The first one is that the aerodynamic shape of the profile of the IVG is not optimized at positions different from the reference one. The second one is that the location of the above fixed axis, around which a tail of the IGV can rotate, does not minimize the actuation force to move the IGV.

As far as the above first disadvantage is concerned, it is evident that simply rotating the tail around its leading edge could produce undesired corners in both suction and pressure side of the integrated profile, wherein overall the integrated profile is defined by the fixed part and the adjustable part. Such corners in turns would generate considerable profile losses. These latter are particularly relevant when the IGV must provide negative angular momentum, i.e. in a condition wherein both mass flow rate and flow deflection are a maximum. In other words, similarly to the downstream stage, the IGV device itself is said overloaded for negative swirl and unloaded for positive swirl.

As far as the actuation force is concerned, instead, this is particularly high because the pivot is close to the leading edge and therefore the length of the lever arm is maximized for the majority of points along the IGV profile, where the flow applies its own pressure. This in turns makes the torque due to flow pressure particularly high.

Therefore there is a general need for an improved device for controlling the flow.

BRIEF DESCRIPTION OF THE INVENTION

An important idea is to provide both the adjustable IGV and the fixed parts as optimized aerodynamic profiles, each one with a proper camber line and thickness distribution.

An additional idea is to dispose the IGV adjacent to the fixed part in order to produce an aerodynamic interaction between them. In particular the IGV and the fixed parts are disposed so as to produce a wake interaction and a potential field interaction between them. Wake interaction is due to the presence of viscous boundary layers, wakes and secondary flows, which all propagate across the downstream airfoils. The potential interaction instead is essentially inviscid and is caused by the interference between the pressure field of adjacent bladerows. This interference decreases monotonically as the distance between the bladerows increases.

For the present subject, the IGV and the fixed parts are designed and arranged so that the interaction between two bladerows generates the so called Coanda effect, which is the tendency of a fluid jet to be attracted to a nearby surface. In particular, the leading edge of the adjustable part is disposed close to the trailing edge of the fixed one in order to produce a substantially converging passage. In such substantially converging passage the flow is continuously accelerated and thus released as a kind of jet. This jet, approaching the leading edge of the next airfoil, is naturally attracted by its suction side. Thanks to this effect, the boundary layer on the moveable IGV remains attached also when they are rotated by an angle that increases the aerodynamic load on them (i.e. negative angular swirl).

It has to be noticed that instead, when the IGV are rotated to produce positive angular swirl, their aerodynamic load decreases and therefore it is not necessary to exploit the Coanda effect to keep the boundary layer attached. Therefore according to an additional idea, the IGV are disposed in such a way that the aforementioned aerodynamic interaction is maximized when the IGV must provide negative swirl.

For the present subject, the IGV angle, i.e. the angle formed by the adjustable part of the IGV device with respect to the meridional direction, may vary between a minimum angle (where the negative swirl is the minimum) and a maximum angle (where the positive swirl is the maximum). When the IGV angle is the minimum, also the distance between the fixed row and the IGV blades is a minimum. According to general turbomachinery convention, the meridional direction is defined by the direction of the vector sum of the axial and radial mean velocities.

It has been noted that the overall effect is maximized, when there is a moveable/adjustable IGV blade for each fixed blade and the relative position and arrangement is replicated for each pair of fixed and moveable blades. This condition is described saying that the fixed and the moveable bladerows have the same periodicity.

According to another possible arrangement, the number of fixed blades is double with respect to the number of moveable IGV. In this case the aerodynamic interaction is guaranteed for half of the fixed blades only. However, for such blades, the effect can be maximized by replicating the same relative position between fixed and moveable blades. Eventually in this case, half of fixed blades (those which are not adjacent to a movable one) can be splitter blades as well. Splitter blades is a name widely used in turbomachinery convention to indicate blades which are shorter than the other blades and which are disposed adjacent to the longer blades.

It is worth noting that in the prior art, the aforementioned aerodynamic interaction is not organized properly nor any Coanda effect is obtained and the boundary layer on the moveable IGV tends to have an anticipated stall with respect to the present device when the aerodynamic load on the IGV increases. As a matter of fact, in the prior art, the channel between the fixed trailing edge and the moveable leading edge is not shaped to obtain any specific aerodynamic effect and in particular is not converging at all. Therefore the flow in the channel between the fixed and the moveable part is not accelerated.

An additional idea is minimizing the actuation force by arranging the fixed axis (also referred to as pivot) close to the center of pressure of the IGV, ideally coincident with it. The center of pressure of an airfoil depends on its aerodynamic load. Therefore, as the IGV rotates, the center of pressure describes an orbit. The IGV orientation giving zero swirl can be considered as the reference one for the definition of the center of pressure of the IGV. This center of pressure can be used to place the fixed pivot of the IGV. Of course the actual instantaneous center of pressure will change following the aforementioned orbit as the IGV will be rotated, but on average (for both negative and positive swirl angles) will remain close to the location associated with zero swirl.

The device for controlling the flow described herein is, in an embodiment, part of a return channel of a centrifugal compressor. In an embodiment axis of rotation of each adjustable blade is parallel to the turbomachine axis. However in another embodiment of the device the axis of rotation of each adjustable blade can be inclined with respect to the turbomachine axis.

First embodiments of the subject matter disclosed herein relate to a device for controlling the flow in a turbomachine, particularly a centrifugal compressor.

Such device comprises: a plurality of fixed blades; a plurality of adjustable blades, said plurality of adjustable blades being arranged adjacent to said plurality of fixed blades so that each of said adjustable blades has an aerodynamic interaction with one of said fixed blades; and wherein: each of said adjustable blades is pivoted about a fixed axis to rotate, with respect to a reference orientation, between a minimum angle and a maximum angle; each of said adjustable blades delivers a substantially deswirled flow when the blade is at said reference orientation; for each of said adjustable blades, said fixed axis is substantially located at a center of pressure of the blade, for each of said adjustable blades, said center of pressure is evaluated when the blade is at said reference orientation.

Second embodiments of the subject matter disclosed herein relate to a turbomachine in particular a centrifugal compressor, comprising a device as set out above.

Third embodiments of the subject matter disclosed herein relate to a method for controlling the flow of a fluid in a turbomachine.

According to such method, said turbomachine comprises at least one fixed blade and at least one corresponding adjustable blade downstream said at least one fixed blade and aerodynamically interacting with said at least one fixed blade; the method comprises the step of controlling said flow by rotating said at least one adjustable blade about a fixed axis located at a center of pressure of the blade; said center of pressure is evaluated when the blade is at a reference orientation.

BRIEF DESCRIPTION OF DRAWINGS

The accompanying drawings, which are incorporated herein and constitute a part of the specification, illustrate exemplary embodiments of the present invention and, together with the detailed description, explain these embodiments. In the drawings.

DETAILED DESCRIPTION

The following description of exemplary embodiments refers to the accompanying drawings.

The following description does not limit the invention. Instead, the scope of the invention is defined by the appended claims.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Figure 1:
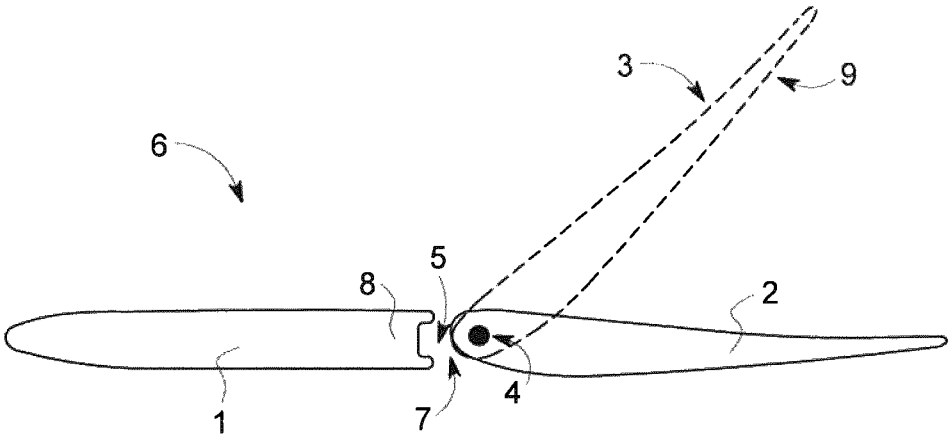
FIG. 1 shows a schematic of an embodiment of the prior art.

FIG. 1 shows a schematic of an embodiment of the prior art where the device 6 comprises a fixed part 1 and a moveable tail 2 located downstream the trailing edge 8 of the fixed part 1. The tail 2 can rotate around a pivot 4 located at the leading edge area 7 of said tail 2. As an example FIG. 1 shows the rotated position 3, corresponding to a high turning condition of the flow. The suction side of the tail at this position 3 is labeled with the numeral reference 9. Whatever is the position of the tail 2, the passage 5 between the fixed part 1 and the moveable part 2 has not any particular aerodynamic shape. It has to be noticed that also the trailing edge 8 of the fixed part 1 does not have even the typical aerodynamic shape of the trailing edge of an airfoil.

Figure 2:
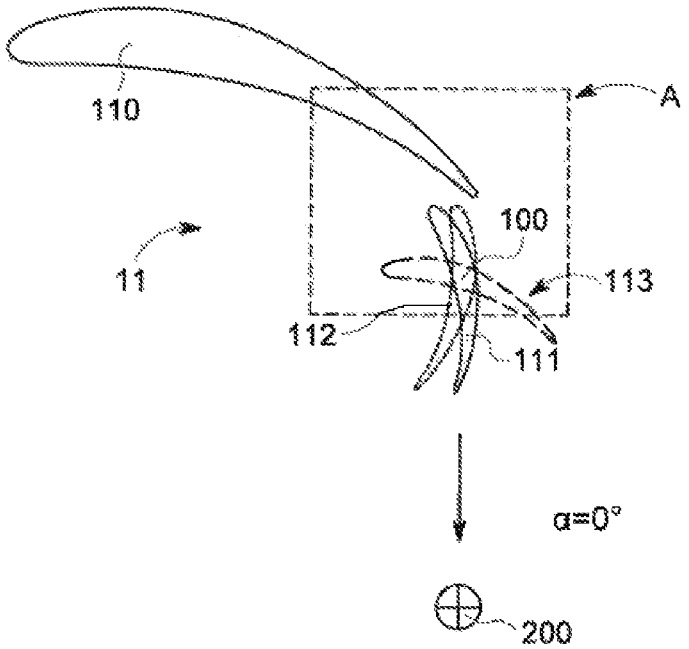
FIG. 2 shows a schematic view of a device for controlling the flow.

FIG. 2 shows a schematic view of a device 11 for controlling the flow in accordance to the present subject matter. In this particular embodiment, the device is part of a return channel of a centrifugal compressor and the axis of the machine is 200. The device 11 comprises a plurality of fixed blades 110 and a plurality of adjustable blades 111. Each of said adjustable blades 111 is arranged so as to have an aerodynamic interaction with a corresponding fixed blade 110.

The fixed blade 110 is shaped as an aerodynamic profile, as well as the corresponding adjustable blade 111. The adjustable blade 111 can rotate about a fixed pivot which defines a fixed axis 100. More in detail the adjustable blade 111 is pivoted about the fixed axis 100 to rotate, with respect to a reference orientation, between a minimum angle and a maximum angle. In FIG. 2 the device is represented in the reference orientation (in the following indicated also with the expression "reference position"), i.e. when the flow released by the adjustable blade 111 has substantially no swirl at the discharge. FIG. 2 also shows the extreme positions 112 and 113 reachable by the adjustable blade 111. In particular, a first position 112 is such that the flow released by the device 11 has minimum swirl angle and a second position 113 is such that has a maximum swirl angle. Moreover the swirl is positive for the second position 113 and negative for the first position 112. The detail A of FIG. 2 is focused on the portion of the device where the aerodynamic interaction between the fixed blade 110 and the adjustable blade 111 is generated.

Figure 3:
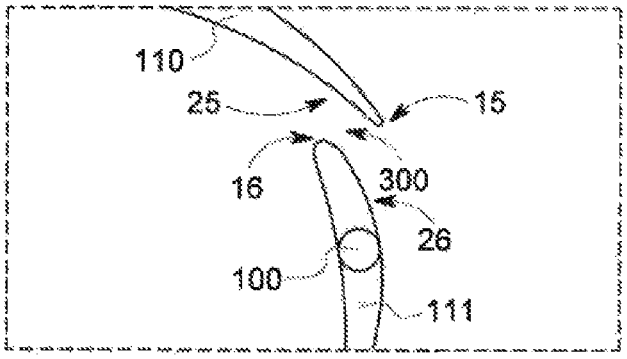
FIG. 3 shows an enlargement of the detail A of FIG. 2.

FIG. 3 shows an enlargement of the detail A of FIG. 2. The pressure side 25 of the fixed blade 110 ends with the trailing edge 15 of the blade 110. The suction side 26 of the adjustable blade 111, instead, begins at the leading edge 16 of the adjustable blade 111. It has to be noticed that the shape of trailing edge 15 of the fixed blade 110 is aerodynamically shaped and in this sense the whole fixed blade 110 is said to be shaped as an aerodynamic profile. This feature can be better appreciated if the trailing edge 15 is compared to the trailing edge 8 of the fixed part of FIG. 1 showing a device of the prior art. The shape of such a trailing edge 8 is not optimized for minimizing the thickness of the released wake and the resulting profile losses are therefore higher than for the trailing edge 15 of FIG. 2. The shape of the channel 300 between the fixed blade 110 and the adjustable blade 111 is worth to be noticed. Such a channel 300 is substantially convergent in such a way that the flow coming from the pressure side 25 of the fixed part 110 accelerates as it moves towards the suction side 26 of the adjustable blade 111. Of course the shape of channel 300 changes when the adjustable blade 111 rotates around the pivot 100. However for the purpose of the present subject matter, it is sufficient that the shape of the channel 300 is substantially convergent, when the adjustable blade is at the position of minimum negative swirl 112. In other words according to the present subject matter, the distance between the suction side 26 of the leading edge 16 and the pressure side 25 of the trailing edge 15 is the minimum when the blade reaches the minimum angle (first position of the adjustable blade 111) so that the flow in the channel 300 is substantially accelerated.

Figure 4:
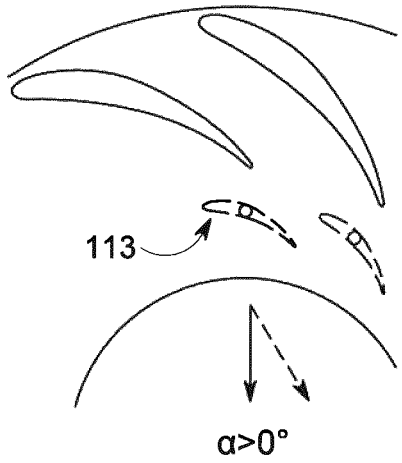
FIGS. 4, 5, and 6 show schematic views of a device for controlling the flow each view referring to a different orientation of the adjustable blades with respect to the fixed blades.
Figure 5:
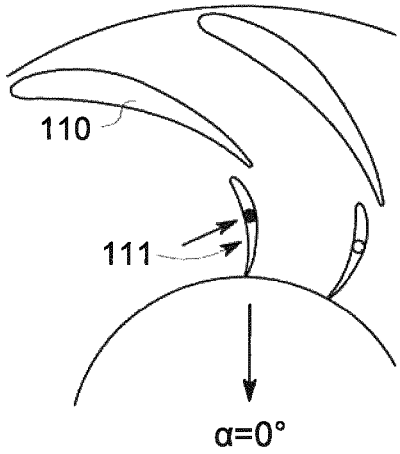
Figure 6:
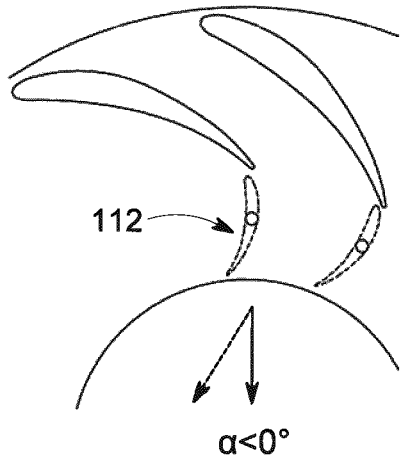

FIG. 4-6 show schematic views of a device for controlling the flow in accordance with the present subject matter, each view referring to a different orientation of the adjustable blade 111. FIG. 4 shows the adjustable blade 111 at its second position 113 corresponding to a maximum positive swirl condition, while FIG. 6 shows the same blade 111 at its first position 112 corresponding to a minimum negative swirl condition. In FIG. 5, instead, the adjustable blade 111 is shown in its reference position/orientation, where the flow delivered by the device 11 has substantially no swirl. It appears evident from the comparison of the FIGS. 4, 5 and 6 that the device 11 applies to the flow the maximum turning, i.e. the maximum change of angular momentum, when the moveable part is at position 112, like in FIG. 6. In this condition the adjustable blade 111 is highly loaded from an aerodynamic standpoint. With reference to FIG. 1, showing a schematic view of a device 6 of the prior art, the condition of high aerodynamic load is the one corresponding to position 3 of the tail (shown in dashed line). In devices like this, the boundary layer on the suction side 9 of the moveable part 2 is prone to separate. On the contrary, in the present subject matter, the boundary layer is prevented from separating thanks to the injection of energized flow, i.e. at high velocity, coming from the channel 300 as labeled in FIG. 3—between the fixed blade 110 and the adjustable blade 111 of the device 11.

Figure 7:
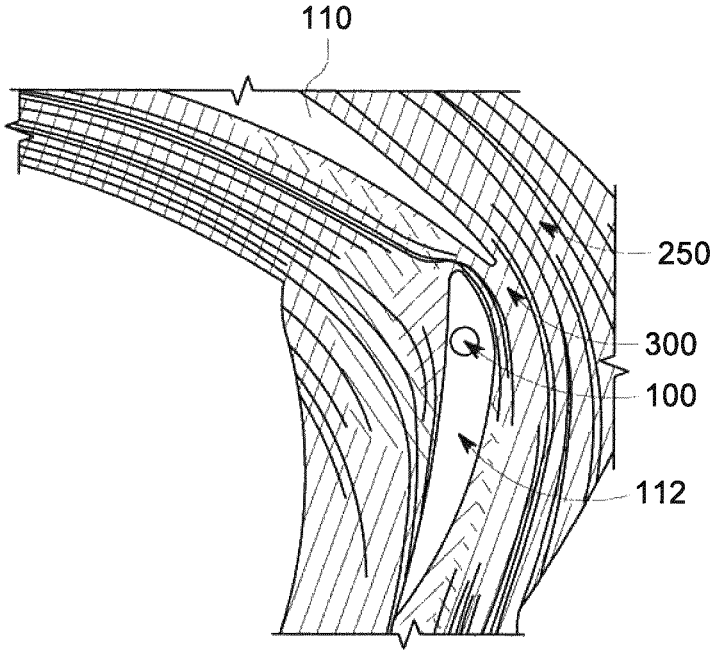
FIG. 7 shows a schematic view of the streamlines around an adjustable blade and a corresponding fixed blade of the device.

FIG. 7 shows a schematic view of the streamlines 250 around the fixed blade 110 and the adjustable blade 111 of the device 11 at its first position 112 of minimum negative swirl. As it can be noticed, thanks to the Coanda effect, the flow remains attached to the suction side 26 of the adjustable blade 111 also in this condition of high aerodynamic load.

Figure 8A:
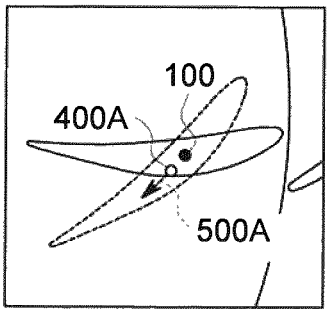
FIGS. 8A, 8B, 8C and 8D show enlargements of the detail A of FIG. 2 with superimposed the aerodynamic force and the center of pressure for different orientations of the adjustable blade with respect to a corresponding fixed blade of the device.
Figure 8B:
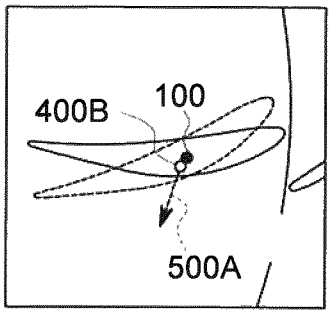
Figure 8C:
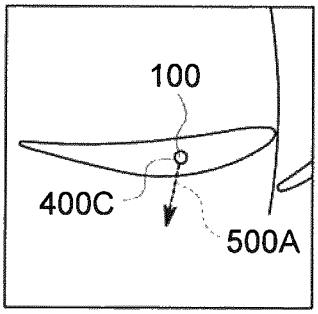
Figure 8D:
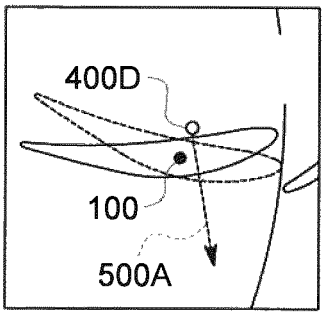

FIG. 8A-8D show enlargements of the detail A of FIG. 2 with superimposed the aerodynamic force and the center of pressure for different orientations of the adjustable blade 111. The position of the center of pressure is labeled with 400A, 400B, 400C and 400D in the FIGS. 8A, 8B, 8C and 8D respectively. Instead the position of the pivot, i.e. of the fixed rotating axis of the adjustable blade 111, is labeled with 100. The aerodynamic force on the moveable part is indicated with 500A, 500B, 500C and 500D respectively. The aerodynamic force is applied by definition in the center of pressure. The force 500A-500D is schematically represented as a vector of increasing length in proportion to the actual value of the force. It can be noticed that the first position reachable by of the adjustable blade 111 (i.e. minimum negative swirl condition), (FIG. 8D) corresponds to the maximum aerodynamic force on the moveable part. In FIG. 8C the reference position of the adjustable blade 111 is schematically represented. According to the present subject matter, the fixed axis 100, around which the adjustable blade 111 can rotate, is substantially located at the center of pressure 400C, i.e. at the center of pressure of the adjustable blade 111 evaluated when the same blade is at the reference position (FIG. 8C). In this way, the torque needed to rotate the adjustable blade 111 around the pivot (fixed axis 100) is minimized.

Figure 9:
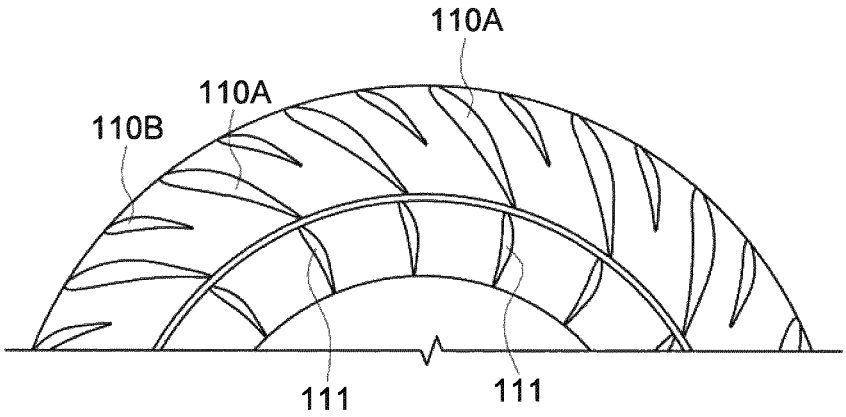
FIG. 9 shows a schematic view of an embodiment of the present device where the fixed blades include splitter blades.

FIG. 9 shows a schematic view of an embodiment of the device of the present subject matter where the fixed blades 110 include long blades 110A and splitter blades 110B. In particular the Coanda effect is here exploited only for the long blades 110A each of which has an aerodynamic interaction with a corresponding adjustable blade 111, while the splitter blades 110B do not interact with the adjustable blades 111.

Figure 10:
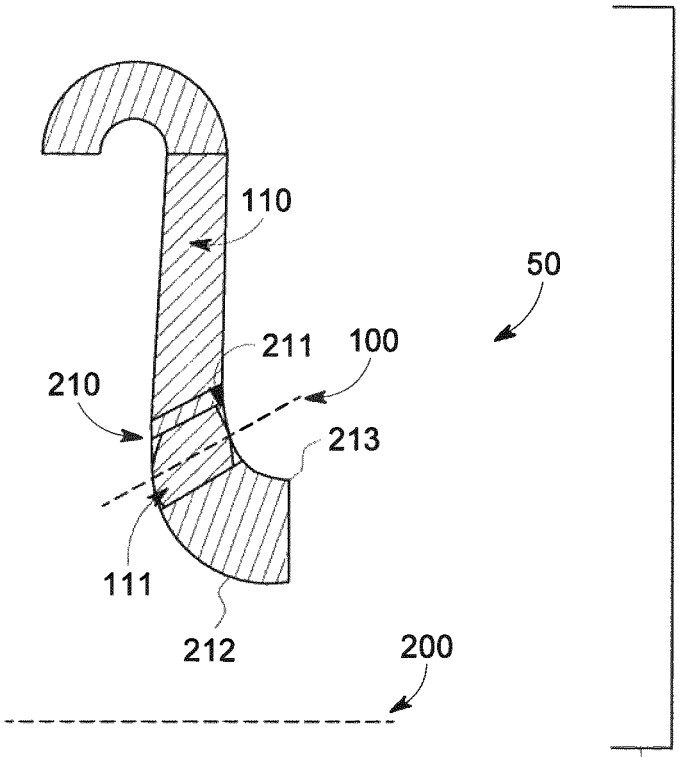
FIG. 10 shows a schematic view of a turbomachine comprising an embodiment of the present device where the axis of rotation of the adjustable blades is inclined with respect to the turbomachine axis.

FIG. 10 shows a schematic view of an embodiment of a turbomachine 50 comprising a device according to the present subject matter where the fixed axis 100 of the adjustable blades 111 is inclined with respect to the turbomachine axis 200. In this case the adjustable blades 111 is must be properly shaped in such a way to avoid interference with the end walls 213 and 212 when the adjustable blades are rotated. For this purpose, a gap 211 and 210 between the end walls and the adjustable blades.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A device for controlling the flow in a turbomachine, the device comprising:

a plurality of fixed blades; and a plurality of adjustable blades, the plurality of adjustable blades being cambered and arranged adjacent to the plurality of fixed blades so that the interaction between the adjustable blades and one of the fixed blades generates a Coanda effect;

wherein:

each of the adjustable blades is pivoted about a fixed axis to rotate, with respect to a reference orientation, between a minimum angle and a maximum angle;

each of the adjustable blades delivers a substantially deswirled flow when the blade is at the reference orientation;

for each of the adjustable blades, the fixed axis is substantially located at a center of pressure of the blade; and for each of the adjustable blades, the center of pressure is evaluated when the blade is at the reference orientation.

2. The device of claim 1, wherein:

each of the fixed blades comprises a trailing edge, the trailing edge comprising a pressure side;

each of the adjustable blades comprises a leading edge, the leading edge comprising a suction side;

and wherein, for each of the adjustable blades, the distance between the suction side of the leading edge and the pressure side of the trailing edge is at a minimum when the blade reaches the minimum angle so that flow of a fluid in a passage between the suction side of the leading edge and the pressure side of the trailing edge is substantially accelerated.

3. The device of claim 1, wherein the plurality of fixed blades comprises long blades and splitter blades.

4. The device of claim 1, wherein the device is located in the turbomachine.

5. The device of claim 4, wherein the fixed axis is parallel to a center axis of the turbomachine.

6. The device of claim 4, wherein the fixed axis is coplanar with the axis of the turbomachine and wherein the fixed axis is inclined with respect to a center axis of the turbomachine.

7. The device of claim 4, wherein the device is part of a return channel of the turbomachine.

8. A turbomachine comprising the device of claim 1, wherein the turbomachine is a centrifugal compressor.

9. A method for controlling the flow of a fluid in a turbomachine, the turbomachine comprising at least one fixed blade and at least one corresponding cambered adjustable blade downstream of the at least one fixed blade and aerodynamically interacting with the at least one fixed blade, the method comprising: controlling the flow by rotating the at least one adjustable blade about a fixed axis located at a center of pressure of the blade, wherein the center of pressure is evaluated when the blade is at an orientation between a minimum angle and a maximum angle; and positioning the at least one adjustable blade such that the interaction between the at least one adjustable blade and the at least one fixed blade generates a Coanda effect.

10. The method according to claim 9, further comprising positioning the at least one adjustable blade such that the interaction between the at least one adjustable blade and the at least one fixed blade generates a positive angular swirl.

11. The method according to claim 9, further comprising pivoting the at least one adjustable blade about a fixed axis to rotate, with respect to a reference orientation, between a minimum angle and a maximum angle.

12. The method according to claim 11, wherein the fixed axis is at the center of pressure of the at least one adjustable blade determined at zero swirl.

* * * * *